US008061791B2

(12) United States Patent
Iftime et al.

(10) Patent No.: US 8,061,791 B2
(45) Date of Patent: Nov. 22, 2011

(54) DUAL PRINTER FOR REGULAR AND RAISED PRINT

(75) Inventors: Gabriel Iftime, Mississauga (CA); Peter M. Kazmaier, Mississauga (CA); Paul F. Smith, Oakville (CA); Hadi K. Mahabadi, Mississauga (CA); Christopher A. Wagner, Etobicoke (CA); Peter G. Odell, Mississauga (CA); Tyler B. Norsten, Oakville (CA)

(73) Assignee: Xerox Corporation, Norwalk, CT (US)

( * ) Notice: Subject to any disclaimer, the term of this patent is extended or adjusted under 35 U.S.C. 154(b) by 212 days.

(21) Appl. No.: 11/683,011

(22) Filed: Mar. 7, 2007

(65) Prior Publication Data

US 2008/0218540 A1 Sep. 11, 2008

(51) Int. Cl.
*B41J 2/01* (2006.01)

(52) U.S. Cl. ..... 347/1; 347/8; 347/5

(58) Field of Classification Search ..... 347/8, 19, 347/1, 103, 88, 5, 9; 156/578
See application file for complete search history.

(56) References Cited

U.S. PATENT DOCUMENTS

| | | | | |
|---|---|---|---|---|
| 4,490,731 | A | 12/1984 | Vaught | |
| 5,059,266 | A | 10/1991 | Yamane et al. | |
| 5,122,187 | A | 6/1992 | Schwarz et al. | |
| 5,340,433 | A * | 8/1994 | Crump | 156/578 |
| 5,506,607 | A * | 4/1996 | Sanders et al. | 347/1 |
| 5,614,933 | A * | 3/1997 | Hindman et al. | 347/103 |
| 5,627,578 | A | 5/1997 | Weintraub | |
| 6,042,227 | A * | 3/2000 | Meinhardt et al. | 347/99 |
| 6,273,536 | B1 * | 8/2001 | Nozawa | 347/8 |
| 6,644,763 | B1 | 11/2003 | Gothait | |
| 6,666,537 | B1 * | 12/2003 | Kelley et al. | 347/8 |
| 6,906,118 | B2 | 6/2005 | Goodbrand et al. | |
| 7,128,412 | B2 | 10/2006 | King et al. | |
| 2004/0036922 | A1 | 2/2004 | Yamada et al. | |
| 2004/0143358 | A1 * | 7/2004 | Silverbrook | 700/121 |

OTHER PUBLICATIONS

U.S. Appl. No. 11/548,774, filed on Oct. 12, 2006 in the name of Iftime et al.

U.S. Appl. No. 11/548,775, filed on Oct. 12, 2006 in the name of Iftime et al.

* cited by examiner

*Primary Examiner* — Lam S Nguyen

(74) *Attorney, Agent, or Firm* — Oliff & Berridge, PLC

(57) ABSTRACT

Disclosed is an ink jet printing device including an ink jet print head and a print region surface toward which ink is jetted from the ink jet print head, wherein a height distance between the ink jet print head and the print region surface is adjustable. The ink jet printing device is thus a dual printing device capable of printing both regular height and raised height images such as Braille.

21 Claims, 2 Drawing Sheets

DUAL PRINTER FOR REGULAR AND RAISED PRINT

BACKGROUND

Described herein is a printing device, more particularly an ink jet printing device, capable of forming images on a substrate in either or both of a regular height and a raised height of print on the substrate. Also described is a method of forming images with the printing device. The printing device herein provides for a low cost means enabling printing in raised height format, for example for Braille and raised graph applications, when required.

U.S. Pat. No. 6,644,763 describes a method for creating raised and special printing effects using ink jet technology. The method includes the steps of depositing a light curable photo-polymer material (18) on the area selected for the printing effects, and curing the area. The amount of material to be deposited corresponds to the area selected for the printing effects and the height of the raised area relative to the medium (22) on which the photo-polymer material (18) is deposited. See the Abstract.

U.S. Pat. No. 5,627,578 describes a method and device for raised letter or graphics printing, by means of a sprayed wet ink deposition on a print substrate. Subsequent dispensing of thermographic powder thereon, with adherence of the powder only to the wet ink, followed by heating to a fixing temperature of the powder, results in the raised lettering or graphics. A standard portable ink jet printer of the bubble jet type, controlled, with graphics software control, by a personal computer, provides the requisite non-contacting ink deposition. The dispensing cartridges of the ink jet printer are provided with non-contact-drying ink formulations (with two or more separate colors, if desired) for the portion of graphics or printing which is to be in raised form. A thermographic powder dispenser and heating member is connected to the output of the ink jet printer, or integrated therewith for completion of the raised printing process. Raised and non-raised printing is also possible by use of separately dispensed drying and non-drying inks. See the Abstract.

Ink jet printing devices are known in the art. For example, ink jet printing devices are generally of two types: continuous stream and drop-on-demand. In continuous stream ink jet systems, ink is emitted in a continuous stream under pressure through at least one orifice or nozzle. The stream is perturbed, causing it to break up into droplets at a fixed distance from the orifice. At the break-up point, the droplets are charged in accordance with digital data signals and passed through an electrostatic field that adjusts the trajectory of each droplet in order to direct it to a gutter for recirculation or a specific location on a recording medium. In drop-on-demand systems, a droplet is expelled from an orifice directly to a position on a recording medium in accordance with digital data signals. A droplet is not formed or expelled unless it is to be placed on the recording medium. There are generally three types of drop-on-demand ink jet systems. One type of drop-on-demand system is a piezoelectric device that has as its major components an ink filled channel or passageway having a nozzle on one end and a piezoelectric transducer near the other end to produce pressure pulses. Another type of drop-on-demand system is known as acoustic ink printing. As is known, an acoustic beam exerts a radiation pressure against objects upon which it impinges. Thus, when an acoustic beam impinges on a free surface (that is, liquid/air interface) of a pool of liquid from beneath, the radiation pressure which it exerts against the surface of the pool may reach a sufficiently high level to release individual droplets of liquid from the pool, despite the restraining force of surface tension. Focusing the beam on or near the surface of the pool intensifies the radiation pressure it exerts for a given amount of input power. Still another type of drop-on-demand system is known as thermal ink jet, or bubble jet, and produces high velocity droplets. The major components of this type of drop-on-demand system are an ink filled channel having a nozzle on one end and a heat generating resistor near the nozzle. Printing signals representing digital information originate an electric current pulse in a resistive layer within each ink passageway near the orifice or nozzle, causing the ink vehicle (usually water) in the immediate vicinity to vaporize almost instantaneously and create a bubble. The ink at the orifice is forced out as a propelled droplet as the bubble expands.

In a typical design of a piezoelectric ink jet device, the image is applied by jetting appropriately colored inks during four to eighteen rotations (incremental movements) of a substrate, such as an image receiving member or intermediate transfer member, with respect to the ink jetting head. That is, there is a small translation of the print head with respect to the substrate in between each rotation. This approach simplifies the print head design, and the small movements ensure good droplet registration. At the jet operating temperature, droplets of liquid ink are ejected from the printing device. When the ink droplets contact the surface of the recording substrate, they quickly solidify to form a predetermined pattern of solidified ink drops.

Ink jet printing processes may employ inks that are solid at room temperature and liquid at elevated temperatures. Such inks may be referred to as solid inks, hot melt inks, phase change inks and the like. For example, U.S. Pat. No. 4,490,731, the disclosure of which is totally incorporated herein by reference, discloses an apparatus for dispensing solid ink for printing on a substrate such as paper. In thermal ink jet printing processes employing hot melt inks, the solid ink is melted by the heater in the printing apparatus and utilized (jetted) as a liquid in a manner similar to that of conventional thermal ink jet printing. Upon contact with the printing substrate, the molten ink solidifies rapidly, enabling the colorant to substantially remain on the surface of the substrate instead of being carried into the substrate (for example, paper) by capillary action, thereby enabling higher print density than is generally obtained with liquid inks. Advantages of a phase change ink in ink jet printing are thus elimination of potential spillage of the ink during handling, a wide range of print density and quality, minimal paper cockle or distortion, and enablement of indefinite periods of nonprinting without the danger of nozzle clogging, even without capping the nozzles.

The use of ink jet printers in forming raised printed images is also known, for example as indicated in U.S. Pat. Nos. 6,644,763 and 5,627,578 above. However, these printers for forming raised images are typically dedicated machines designed and used solely for raised print applications, such as forming Braille images. Where a user requires only a certain portion of print jobs to be done utilizing raised print, it can be costly for the user to have two print devices, one strictly for the raised print jobs.

What is still desired is a cost-effective ink jet printing device that is capable of forming both regular print images and raised print images.

SUMMARY

These and other objects may be achieved herein by providing an ink jet printing device comprising an ink jet print head and a print region surface toward which ink is jetted from the ink jet print head, wherein a height distance between the ink jet print head and the print region surface is adjustable.

Also described herein is an ink jet printing system comprising an ink jet printing device comprising an ink jet print head and a print region surface toward which ink is jetted from the ink jet print head, wherein a height distance between the ink jet print head and the print region surface is adjustable, and a controller for controlling the height distance.

Still further, described is a method of forming an image on a substrate with an ink jet printing device comprising an ink jet print head and a print region surface toward which ink is jetted from the ink jet print head, wherein a height distance between the ink jet print head and the print region surface is adjustable, comprising determining if the image is to be printed having a regular print height, a raised print height, or a combination of both, and printing the image with the print height(s) by jetting ink from the ink jet print head, wherein for images or portions thereof to have a raised print height, forming the raised print height by depositing multiple layers of the ink in locations of the image or portion thereof to have the raised print height, and adjusting to increase the height distance between the ink jet print head and the print region surface as necessary to prevent the raised print locations from contacting the ink jet print head during formation.

EMBODIMENTS

Advantages of the apparatus and methods herein include that raised print, for example Braille and raised graphs, can be formed using a same device capable of also producing regular height print images. The dual ink jet printing device is thus cost effective in avoiding a user having to have both a dedicated raised height printing device and a regular printing device.

The apparatus will first be discussed. The apparatus is an ink jet printing device that includes at least an ink jet print head and a print region surface toward which ink is jetted from the ink jet print head, wherein a height distance between the ink jet print head and the print region surface is adjustable.

The apparatus, as well as the methods herein, may be employed with any desired printing system and marking material suitable for applying a marking material in an imagewise pattern to an intermediate transfer member or directly to an image receiving substrate, such as thermal ink jet printing (both with inks liquid at room temperature and with phase change inks), piezoelectric ink jet printing (both with inks liquid at room temperature and with phase change inks), acoustic ink jet printing (both with inks liquid at room temperature and with phase change inks), thermal transfer printing, gravure printing, electrostatographic printing methods (both those employing dry marking materials and those employing liquid marking materials), and the like. For the purpose of illustration, a piezoelectric phase change ink jet printer for applying marking material in an imagewise pattern to an intermediate transfer member is described.

Figure 1:
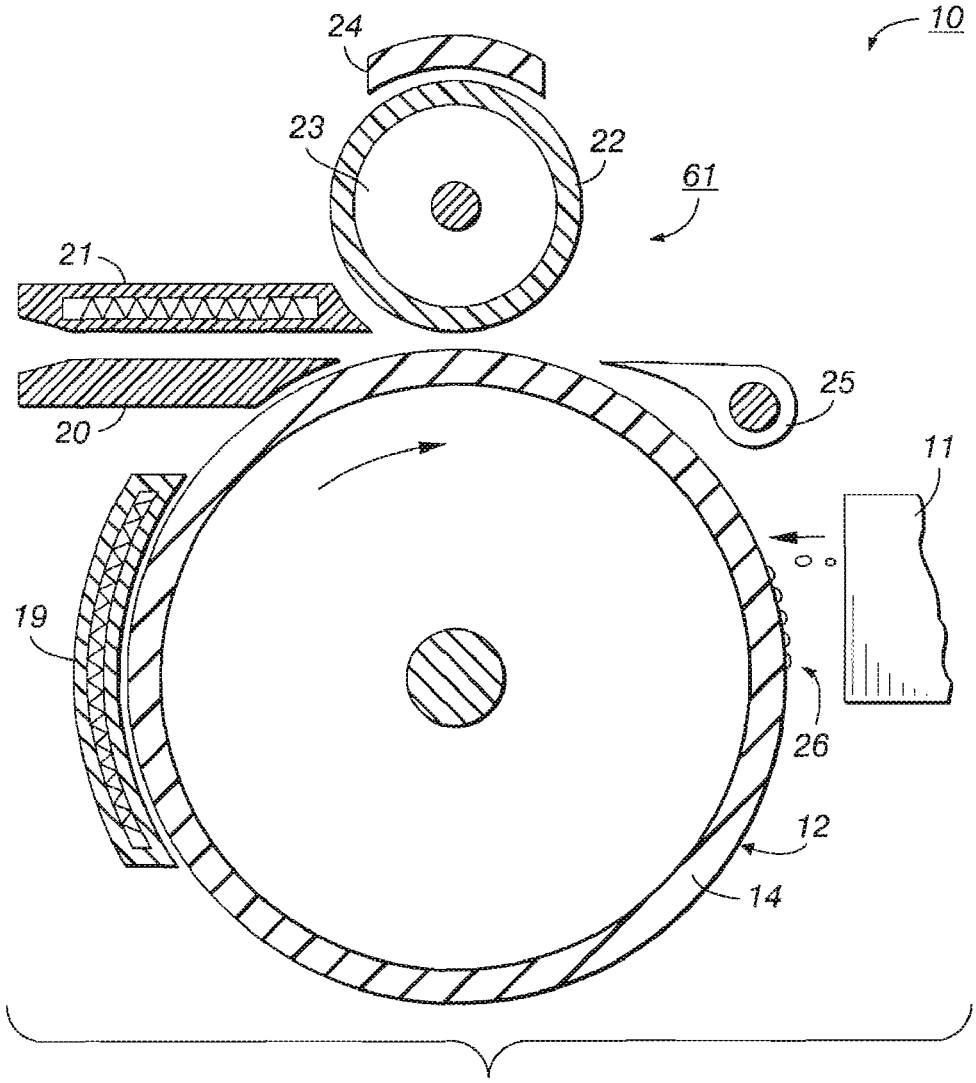
FIG. 1 is a side view of one apparatus for use in conjunction with embodiments herein.
Figure 2:
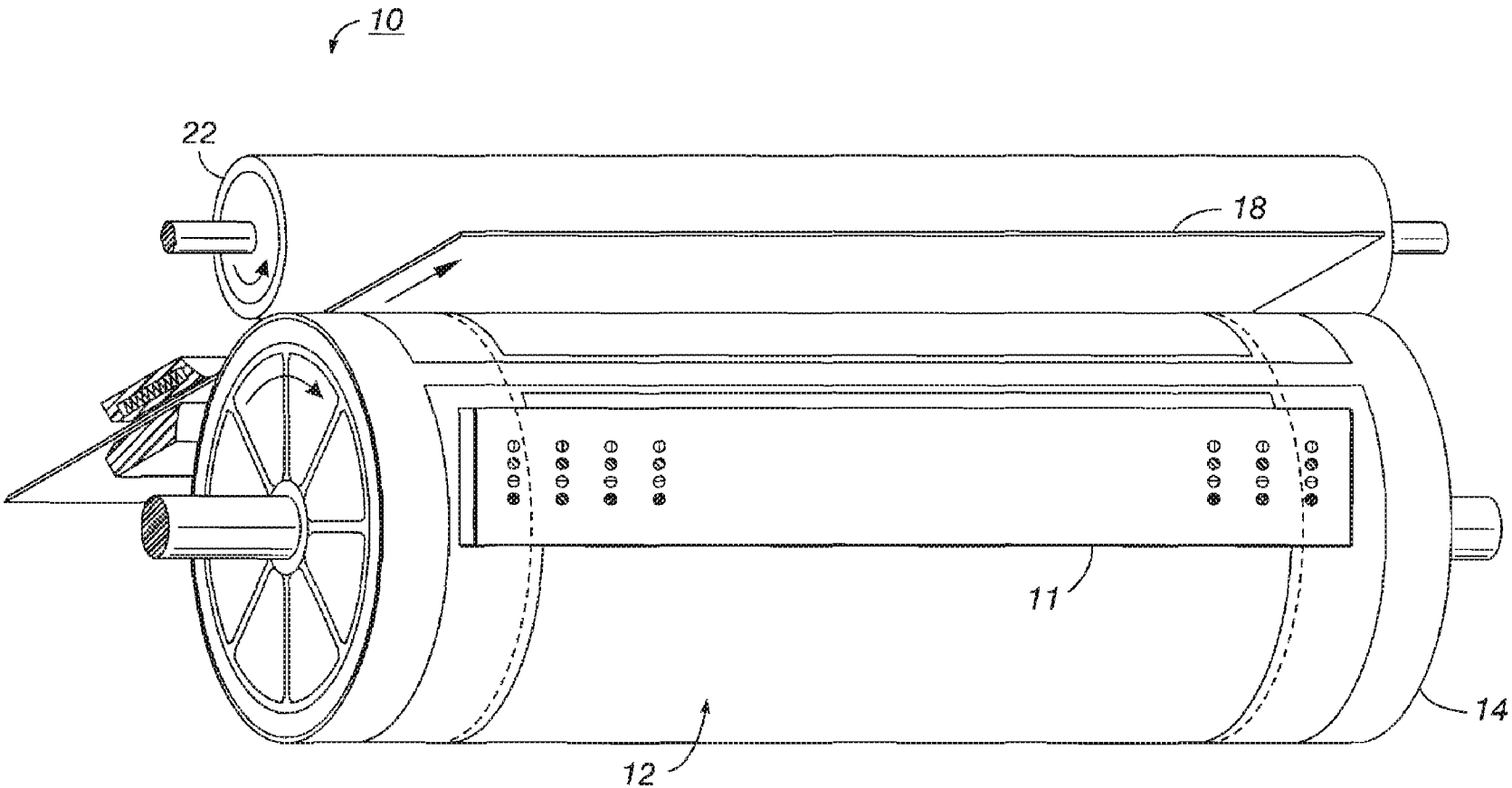
FIG. 2 is a perspective view of an apparatus similar to that shown in FIG. 1.

FIGS. 1 and 2 diagrammatical illustrate an example of a suitable imaging apparatus 10 for forming an image on an intermediate transfer member and subsequently transferring that image from the intermediate transfer member to a final image receiving substrate. The illustrated imaging apparatus 10 includes an intermediate transfer member 14. A marking material applicator, in this case an ink jet head, 11 applies marking material in an imagewise pattern 26 onto the surface 12 of the intermediate transfer member. This surface 12 is a print region surface toward which the ink jet head 11 jets the marking material in forming an image. In this illustrated case, the print region surface is the intermediate transfer member surface. However, in embodiments wherein the marking material is jetted directly to an image receiving substrate such as paper, the print region surface would be the surface of the image receiving substrate.

In the Figures, the intermediate transfer member 14 is shown as a roll or drum. However, it may have any suitable form, for example including a belt, web, platen, or any other suitable design.

As shown in FIGS. 1 and 2, the apparatus may also include a transferring apparatus 61 including, for example, a transfer roll 22 where the imagewise pattern of marking material from the intermediate transfer member surface is transferred onto an image receiving substrate 18. An optional image receiving substrate guide 20 may be used to pass the image receiving substrate from a feed device (not shown) and guide the substrate through the nip formed by the opposing arcuate surfaces of the roll 22 and the intermediate transfer member 14. Optional stripper fingers 25 may be mounted to the imaging apparatus 10 to assist in removing the image receiving substrate from the surface of the intermediate transfer member 14. Roll 22 may have a metallic core 23, such as steel, with an elastomeric covering such as, for example, urethanes, nitrites, EPDM, and other appropriately resilient materials. Fusing of the image on the image receiving substrate may also be effected at this transferring apparatus.

Once the image 26 enters the nip, it is transferred to its final image conformation and adheres or is fixed to the image receiving substrate either by the pressure exerted against the image 26 on the substrate 18 by the roll 22 alone, or by the combination of the pressure and heat supplied by optional heater 21 and/or optional heater 19. Optional heater 24 may also be employed to supply heat to facilitate the process at this point. Once adhered and/or fused to the image receiving substrate, the image is cooled to ambient temperature, for example from about 22 to about 27° C.

The ink jet print head 11 may be supported by an appropriate housing and support elements (not shown). In conventional image forming devices, the ink jet print head is mounted so as to be stationary, or at most is mounted so as to be a fixed distance from the print region surface but movable axially across the face of the print region, for example movable in a direction toward and away from a viewer viewing FIG. 1.

In the apparatus of embodiments herein, however, the ink jet print head is mounted so as to be adjustable in distance with respect to the distance between the ink jet print head and the print region surface, also referred to herein as the height distance between the ink jet print head and the print region surface.

In embodiments, the ink jet print head is positioned in a standard position for forming regular height images on an intermediate transfer member or an image receiving substrate. A regular height image typically has a print height of from about 5 μm to about 12 μm for a single color, for example of about 8 μm, which may thus be as high as about 20 to about 45 μm for stacked multiple colors, for example in portions of a full color printed image. For this, the ink jet print head may be positioned from about 80 μm to about 200 μm, for example about 100 μm, from the print region surface toward which the head will jet marking material.

In embodiments, this "regular height position" of the ink jet print head will represent a first height distance, which may be a minimum height distance, between the ink jet print head and the print region surface, and in which the print head is at its closest position to the print region surface.

While this first position of the ink jet print head is acceptable for printing regular height single or multi-color images, a difficulty arises when attempting to form raised height images. For example, for Braille applications, the height of the image should be at least about 200 μm in order for the image to be readily detected and properly deciphered by touch. If it is attempted to build-up the height of the image to over 200 μm, for example through known techniques such as multiple passes with the ink jet print head, the ink jet print head will ultimately contact and damage the printed image. There is thus a print height limit beyond which a standard ink jet printing device cannot print. This is why standard ink jet printers are not used in forming raised height images, and why users are forced to purchase separate printing devices that are dedicated to forming raised height images.

Herein, the ink jet print head is adjustable in spacing with respect to the print region surface so as to permit the ink jet print head to be moved from the above described first position for regular height printing to a second height distance that is greater than (that is, the spacing between the ink jet print head and the print region surface is greater than) the first height distance. The second height distance is not fixed, and can be varied as necessary for a given printing. Moreover, the second height distance can itself be changed during a printing, as necessary. For example, it may be desirable to adjust the height distance from the first position to a first second position as an image is built-up by the ink jet print head, and then as the image continues to be built-up, to adjust the ink jet print head from the first second position to a second position in which the spacing from the print region surface is even further increased, and so on as necessary to complete build-up of the image.

In building up an image, for example by way of multiple passes of the print head over the portions of the image to include raised images, each layer of the image may have a print height of from about 4 μm to about 12 μm. An appropriate number of passes or ink jettings may be selected so that a raised image can be built up to a desired total print height, for example of at least about 80 μm, such as from about 80 μm to about 600 μm, or from about 300 μm to about 500 μm.

The ink jet head may support single color or full color printing. In full color printing, the ink jet head typically includes different channels for printing the different colors. As illustrated in FIG. 2, the ink jet head may include four different sets of channels, for example one for each of cyan, magenta, yellow and black. In such embodiments, the print head is capable of printing either full color regular height prints when the ink jet head is set at a minimum distance from the print region surface, or raised height prints of any color combination when the ink jet head is at a distance greater than the minimum distance from the print region surface.

In adjusting the height of the ink jet print head with respect to the print region surface, any suitable height adjustment mechanism may be used. The height adjustment mechanism may be associated with either the ink jet print head or the print region surface. In embodiments where the ink jet print head jets towards an intermediate transfer member as the print region surface, it may be more practical to have the height adjustment mechanism associated with the ink jet print head, for example because adjusting the location of the intermediate transfer member in the form of a roll or drum may be more difficult due to the possible presence of other devices associated with the intermediate transfer member, such as the transferring apparatus. However, where the print region surface is in the form of a belt, the height adjustment mechanism may include any type of mechanism, for example rollers and the like, that may be used to move or pull the path of the belt further away from the ink jet print head, and thus it is quite possible to have a height adjustment mechanism associated with the print region surface.

For the ink jet print head, any suitable height adjustment mechanism may be used. For example, the housing of frame upon which the ink jet print head is mounted may include an actuator (or microactuator) for making the appropriate adjustments in the height distance, for example by actuating the print head mounted in the frame away from the print region surface the appropriate distance, for example a distance of from about 10 μm to about 1,000 μm, such as from about 10 μm to about 800 μm further away from the print region surface with respect to the first or minimum positioning of the ink jet print head. The actuator may be located at points where the ink jet print head is mounted to the frame so that the mounting includes the height distance adjustment means.

Additional examples of height adjustment mechanisms may include, for example, mounting the ink jet print head on a mount that can swing up or down around a pivot such as a rotatable shaft retractor fixedly attached to the mount so that rotation of the shaft moves the ink jet print head toward or away from the print region surface. A retractor may also be used to move the mount linearly toward and away from the print region surface. Any other method of moving the mounted ink jet print head toward and away from the print region surface may also be employed, such as a biasing mechanism, for example, a spring, positive hydraulic pressure, positive pneumatic pressure, a screw mechanism, and the like.

For the print region surface, any suitable height adjustment mechanism may be used. Example belt height adjustment mechanisms are indicated above. Where the print region surface is in the form of a roll or drum, the mechanism may include, for example, a mechanism associated with the side axes of the roll or drum so as to move, for example by rotating away from the ink jet print head or otherwise physically moving the print region surface away from the ink jet print head.

The height adjustment mechanism may be controlled by a controller, which may be a same controller that controls the ink jetting of the ink jet print head. In this way, the ink jet print head height distance from the print region surface can be appropriately adjusted as required during printing of a raised height image.

For raised height printing, the printed image may be formed by any suitable ink jet process that can form images on a substrate with a desired height. For example, the raised printed markings may be formed with appropriate multiple passing of the ink jet print head over the portions requiring the raised height. Jetting of ink from multiple different ink jets of the ink jet head toward a same location of the image during a single pass may also be used to form raised height images. As discussed above, each layer of ink may add from about 4 μm to about 12 μm in height to the image height. Knowing the total print height desired, the appropriate number of passes or jettings may be readily determined.

In forming images using a dual printing device such as described herein, a first step may be to determine if the image is to be printed having a regular print height, a raised print height, or a combination of both. A controller may then control the ink jet print head to deposit the appropriate amount and/or layers of ink at locations of the image so as to obtain the image with the desired print heights therein.

As marking materials for forming the printed image, any marking material that is capable of forming a regular height or a raised height printed image may be used. In this regard, solid ink marking materials are suitable for paper substrates. It may be more difficult to use liquid ink marking materials on paper substrates, as such tend to absorb into the paper substrate rather than build height thereon. However, this is not to say that liquid ink marking materials cannot be used in certain applications and/or used when height building measures are taken, for example using gallants, UV curing or blue light curing to prevent substantial diffusion into the paper substrate.

Any conventional marking materials, inclusive of inks and toners, may be used. Examples of suitable marking materials include inks, including lithographic and flexographic inks, aqueous inks, including those suitable for use with ink jet printing processes, liquid and dry toner materials suitable for use in electrostatic imaging processes, solid hot melt inks, including those suitable for use with ink jet printing processes, and the like. As indicated above, solid inks may provide particularly desirable control and results.

Such marking materials typically comprise at least a vehicle with a colorant such as pigment, dye, mixtures of pigments, mixtures of dyes, or mixtures of pigments and dyes, therein. The colorant may be present in a colored marking material in any desired amount, for example from about 0.5 to about 75% by weight of the marking material, for example from about 1 to about 50% or from about 1 to about 25%, by weight of the marking material.

As colorants, examples may include any dye or pigment capable of being dispersed or dissolved in the vehicle. Examples of suitable pigments include, for example, PALIOGEN Violet 5100 (BASF); PALIOGEN Violet 5890 (BASF); HELIOGEN Green L8730 (BASF); LITHIOL, Scarlet D3700 (BASF); SUNFAST® Blue 15:4 (Sun Chemical 249-0592); HOSTAPERM Blue B2G-D (Clariant); Permanent Red P-F7RK; HOSTAPERM Violet BL (Clariant); LITHOL Scarlet 4440 (BASF); Bon Red C (Dominion Color Company); ORACET Pink RF (Ciba); PALIOGEN Red 3871 K (BASF); SUNFAST® Blue 15:3 (Sun Chemical 249-1284); PALIOGEN Red 3340 (BASF); SUNFAST® Carbazole Violet 23 (Sun Chemical 246-1670); LITHOL Fast Scarlet L4300 (BASF); Sunbrite Yellow 17 (Sun Chemical 275-0023); HELIOGEN Blue L6900, L7020 (BASF); Sunbrite Yellow 74 (Sun Chemical 272-0558); SPECTRA PAC® C Orange 16 (Sun Chemical 276-3016); HELIOGEN Blue K6902, K6910 (BASF); SUNFAST® Magenta 122 (Sun Chemical 228-0013); HELIOGEN Blue D6840, D7080 (BASF); Sudan Blue OS (BASF); NEOPEN Blue FF4012 (BASF); PV Fast Blue B2GO1 (Clariant); IRGALITE Blue BCA (Ciba); PALIOGEN Blue 6470 (BASF); Sudan Orange G (Aldrich); Sudan Orange 220 (BASF); PALIOGEN Orange 3040 (BASF); PALIOGEN Yellow 152, 1560 (BASF); LITHOL Fast Yellow 0991 K (BASF); PALIOTOL Yellow 1840 (BASF); NOVOPERM Yellow FGL (Clariant); Lumogen Yellow D0790 (BASF); Suco-Yellow L1250 (BASF); Suco-Yellow D1355 (BASF); Suco Fast Yellow D1 355, D1 351 (BASF); HOSTAPERM Pink E 02 (Clariant); Hansa Brilliant Yellow 5GX03 (Clariant); Permanent Yellow GRL 02 (Clariant); Permanent Rubine L6B 05 (Clariant); FANAL Pink D4830 (BASF); CINQUASIA Magenta (DU PONT) PALIOGEN Black L0084 (BASF); Pigment Black K801 (BASF); and carbon blacks such as REGAL 330™ (Cabot), Carbon Black 5250, Carbon Black 5750 (Columbia Chemical), mixtures thereof and the like. Examples of suitable dyes include Usharect Blue 86 (Direct Blue 86), available from Ushanti Color; Intralite Turquoise 8GL (Direct Blue 86), available from Classic Dyestuffs; Chemictive Brilliant Red 7BH (Reactive Red 4), available from Chemiequip; Levafix Black EB, available from Bayer; Reactron Red H8B (Reactive Red 31), available from Atlas Dye-Chem; D&C Red #28 (Acid Red 92), available from Warner-Jenkinson; Direct Brilliant Pink B, available from Global Colors: Acid Tartrazine, available from Metrochem Industries; Cartasol Yellow 6GF Clariant; Carta Blue 2GL, available from Clariant; and the like. Example solvent dyes include spirit soluble dyes such as Neozapon Red 492 (BASF); Orasol Red CG (Ciba); Direct Brilliant Pink B (Global Colors); Aizen Spilon Red C-BH (Hodogaya Chemical); Kayanol Red 3BL (Nippon Kayaku); Spirit Fast Yellow 3G; Aizen Spilon Yellow C-GNH (Hodogaya Chemical); Cartasol Brilliant Yellow 4GF (Clariant); Pergasol Yellow CGP (Ciba); Orasol Black RLP (Ciba); Savinyl Black RLS (Clariant). Morfast Black Conc. A (Rohm and Haas); Orasol Blue GN (Ciba); Savinyl Blue GLS (Sandoz); Luxol Fast Blue MBSN (Pylam); Sevron Blue 5GMF (Classic Dyestuffs); Basacid Blue 750 (BASF), Neozapon Black X51 [C.I. Solvent Black, C.I. 12195] (BASF), Sudan Blue 670 [C.I. 61554] (BASF), Sudan Yellow 146 [C.I. 12700] (BASF), Sudan Red 462 [C.I. 260501] (BASF), mixtures thereof and the like.

As the marking material vehicle, any ink or toner vehicle may be suitably used. For phase change solid inks, the vehicle may be any of those described in U.S. patent application Ser. No. 11/548,775, U.S. Pat. No. 6,906,118 and/or U.S. Pat. No. 5,122,187, each incorporated herein by reference in its entirety. The ink vehicle may also be radiation curable, for example UV or blue light curable, and including any of the ink vehicles described in U.S. patent application Ser. No. 11/548,774, incorporated herein by reference in its entirety. The ink vehicle may also be any toner polymer binder, for example such as a polyester or a polyacrylate and the like.

Where the marking material is radiation curable, the marking material may be cured after deposition of each layer in a raised height image, but more desirably in the interest of time is cured upon completion of deposition of all layers of the raised height image.

The marking material vehicle may also include a wax such as paraffins, microcrystalline waxes, polyolefin waxes such as polyethylene or polypropylene waxes, ester waxes, fatty acids and other waxy materials, fatty amide containing materials, sulfonamide materials, resinous materials made from different natural sources (tall oil rosins and rosin esters, for example), and synthetic waxes. The wax may be present in an amount of from about 5% to about 60% by weight of the marking material. Examples of suitable waxes include polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected usually possess a molecular weight of from about 1,000 to about 1,500, while the commercially available polypropylenes utilized for the toner compositions of the present invention are believed to have a molecular weight of from about 4,000 to about 5,000. Examples of suitable functionalized waxes include, for example, amines, amides, imides, esters, quaternary amines, carboxylic acids or acrylic polymer emulsion, for example JONCRYL™ 74, 89, 130, 537, and 538, all available from SC Johnson Wax, chlorinated polypropylenes and polyethylenes commercially available from Allied Chemical and Petrolite Corporation and SC Johnson wax.

The following example confirms the use of a dual printer for forming raised height images. A Xerox Phaser 860 ink jet printer was appropriately modified for multiple passes. Raised images were written via multiple passes with a head temperature of 140° C., an intermediate drum temperature of 64° C. and a paper preheat temperature of 60° C. After 5 passes, the printed text had a pile height of about 35 to about 45 μm on the paper, and upon touching could be felt upon the paper. The height can be raised further via additional passes.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An ink jet printing device, comprising a controller, an ink jet print head and a print region surface toward which ink is jetted from the ink jet print head, wherein a height distance between the ink jet print head and the print region surface is adjustable, and a fixing device that fixes the ink jetted from the ink jet print head to the print region surface by a contact force that directly applies pressure and optional heat to the ink jetted from the print head, wherein the ink jet print head is capable of printing either regular height prints when the ink jet head is set at a minimum height distance from the print region surface, or raised height prints when the ink jet print head is at a distance greater than the minimum distance from the print region surface, the controller controls the ink jet print head to incrementally adjust the height distance between the ink jet print head and a previously applied ink layer after each layer of a raised height print is printed, the adjustable height distance comprises:

a first height distance from about 80 μm to about 200 μm representing the minimum height distance between the ink jet print head and the print region surface, and in which the ink jet print head is closest to the print region surface, and a second height distance that is greater than the first height distance;

when the ink jet print head is positioned so as to be spaced from the print region surface a distance corresponding to the first height distance, the ink jet print head prints ink images having an individual layer regular height of about 5 μm to about 10 μm, and when the ink jet print head is positioned so as to be spaced from the print region surface a distance corresponding to the second height distance, the print head prints ink images having a raised height of at least about 80 μm or more.

2. The ink jet printing device according to claim 1, wherein the ink jet head is a full color ink jet print head with channels for jetting each of cyan, magenta, yellow and black, and wherein the ink jet print head is capable of printing either full color regular height prints when the ink jet head is set at the minimum height distance from the print region surface, or raised height prints of any color combination when the ink jet print head is at the distance greater than the minimum distance from the print region surface.

3. The ink jet printing device according to claim 1, wherein the ink jet printing device includes a height adjustment mechanism for adjusting the height distance of the ink jet print head from the print region surface.

4. The ink jet printing device according to claim 3, wherein the height adjustment mechanism is attached to the ink jet print head to move the ink jet print head with respect to the print region surface.

5. The ink jet printing device according to claim 3, wherein the height adjustment mechanism is attached to the print region surface to move the print region surface with respect to the ink jet print head.

6. The ink jet printing device according to claim 1, wherein the print region surface comprises a surface of an intermediate transfer member.

7. The ink jet printing device according to claim 6, wherein the ink printing device further includes a transfer station, wherein the ink image on the intermediate transfer device is transferred to a substrate.

8. The ink jet printing device according to claim 1, wherein the ink jet print head jets phase change ink.

9. The ink jet printing device according to claim 1, wherein the fixing device comprises a roll.

10. An ink jet printing system, comprising:

an ink jet printing device comprising an ink jet print head and a print region surface toward which ink is jetted from the ink jet print head, wherein a height distance between the ink jet print head and the print region surface is adjustable, a fixing device that fixes the ink jetted from the ink jet print head to the print region surface by a contact force that directly applies pressure and optional heat to the ink jetted from the print head, and a controller for controlling the height distance, wherein the ink jet print head is capable of printing either regular height prints when the ink jet head is set at a minimum height distance from the print region surface, or raised height prints when the ink jet print head is at a distance greater than the minimum distance from the print region surface, the controller controls the ink jet print head to incrementally adjust the height distance between the ink jet print head and a previously applied ink layer after each layer of a raised height print is printed, the minimum height distance is from about 80 μm to about 200 μm, the raised height distance is at least about 80 μm or more, and when the ink jet print head is positioned at the minimum height distance, the ink jet print head prints ink images having an individual layer regular height of about 5 μm to about 10 μm.

11. The ink jet printing system according to claim 10, wherein the controller increases the height distance during printing of a raised print image.

12. The ink jet printing system according to claim 10, wherein the controller is associated with a height adjustment mechanism.

13. The ink jet printing system according to claim 12, wherein the height adjustment mechanism is attached to the ink jet print head to move the ink jet print head with respect to the print region surface.

14. The ink jet printing system according to claim 10, wherein the fixing device comprises a roll.

15. A method of forming an image on a substrate with an ink jet printing device comprising a controller, an ink jet print head and a print region surface toward which ink is jetted from the ink jet print head, wherein a height distance between the ink jet print head and the print region surface is adjustable, the method comprising:

determining if the image is to be printed having a regular print height that is not readily deciphered by human touch, a raised print height that is readily deciphered by human touch, or a combination of both, and printing the image with the print height(s) by jetting ink from the ink jet print head, wherein for images or portions thereof to have a raised print height, forming the raised print height by depositing multiple layers of the ink in locations of the image or portion thereof to have the raised print height, and controlling the ink jet print head to incrementally adjust the height distance between the ink jet print head and a previously applied ink layer after each layer of a raised height print is printed, and fixing the image to the print region surface using a fixing device by a contact force that directly applies pressure and optional heat to the deposited ink layers, wherein each ink layer has a print height of from about 5 μm to about 10 μm.

16. The method according to claim 15, wherein the printing of the image comprises jetting an ultraviolet or blue light curable ink.

17. The method according to claim 16, wherein each layer of the curable ink in a multiple layer raised print location is cured prior to deposition of a subsequent layer.

18. The method according to claim 16, wherein multiple layers of the curable ink at raised print locations are cured upon completion of deposition of a last of the multiple layers.

19. The method according to claim 15, wherein the ink jet head jets to an intermediate transfer member, and the image thereon is subsequently transferred to a substrate.

20. The method according to claim 15, wherein the ink jet head jets directly to an image receiving substrate.

21. The ink jet printing system according to claim 15, wherein the fixing device comprises a roll.

* * * * *